US007234337B2

(12) United States Patent
Nagae

(10) Patent No.: US 7,234,337 B2
(45) Date of Patent: Jun. 26, 2007

(54) PUNCH PRESS

(75) Inventor: Masayuki Nagae, Kounan (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 385 days.

(21) Appl. No.: 10/896,065

(22) Filed: Jul. 22, 2004

(65) Prior Publication Data

US 2005/0040775 A1 Feb. 24, 2005

(30) Foreign Application Priority Data

Aug. 8, 2003 (JP) ..... 2003-290500

(51) Int. Cl.
*B21J 9/18* (2006.01)

(52) U.S. Cl. ..... 72/449; 72/452.5; 100/282

(58) Field of Classification Search ..... 72/449, 72/450, 452.5; 83/628, 629; 74/665 B, 74/424.5; 100/280, 281, 282, 283, 293
See application file for complete search history.

(56) References Cited

U.S. PATENT DOCUMENTS 2,771,790 A * 11/1956 Munschauer ..... 74/665 B
4,416,168 A * 11/1983 Arai et al. ..... 475/142

FOREIGN PATENT DOCUMENTS

| | | | |
|---|---|---|---|
| DE | 949 863 | | 9/1956 |
| EP | 0 941 832 A1 | | 9/1999 |
| EP | 0941832 | * | 9/1999 |
| FR | 1.369.083 | | 8/1964 |
| FR | 1.573.182 | | 7/1969 |
| JP | 6-344059 | | 12/1994 |
| JP | 07-276096 | | 10/1995 |
| JP | 10-109237 | | 4/1998 |
| JP | 2000-312995 | | 11/2000 |

OTHER PUBLICATIONS

European Search Report, dated Dec. 23, 2005, issued in corresponding European Application No. EP 04 01 7531.
Office Action dated Nov. 28, 2006 issued in corresponding Chinese Application No. 2004-100562804.

* cited by examiner

*Primary Examiner*—Derris H. Banks
*Assistant Examiner*—Debra M Wolfe
(74) *Attorney, Agent, or Firm*—Westerman, Hattori, Daniels & Adrian, LLP.

(57) ABSTRACT

A punch press that provides an arrangement of a motor and a crank mechanism so that the motor does not project far from the side of a frame. The punch press includes a servo motor, a ram which drives a press tool, a crank mechanism which converts a rotating motion transmitted to a crank shaft into an elevating and lowering operation of the ram, and a drive transmitting mechanism which transmits rotation of the servo motor to the crank shaft while reducing rotation speed. The servo motor is next to the crank mechanism and its rotating axis is parallel to the axis of the crank shaft. The drive transmitting mechanism includes servo motor side gears joined to respective output shafts of the servo motor. The servo motor side gears respectively engage, directly or via intermediate gears, with crank side gears joined to the crank shaft.

4 Claims, 10 Drawing Sheets

PUNCH PRESS

FIELD OF THE INVENTION

The present invention relates to a motor-driven punch press driven by a servo motor or the like.

BACKGROUND OF THE INVENTION

Mechanical punch presses generally employ a crank mechanism as a slide driving mechanism that converts a rotating operation of a motor into an elevating and lowering operation of a ram. In such a punch press, a flywheel is generally connected to a crank shaft so that rotation of the motor can be transmitted to a crank mechanism via the flywheel (for example, the Unexamined Japanese Patent Application Publication (Tokkai-Hei) No. 6-344059).

In a recently proposed mechanical punch press, a rotating operation of a servo motor is converted into an elevating and lowering operation of the ram via the crank mechanism without the need for the flywheel. The use of servo motor driving makes it possible to control the speed at which the ram elevates and lowers during a stroke. For example, the punch tool can be made to operate quietly by reducing the speed of the ram immediately before it comes into contact with a plate material. FIGS. 7 to 10 show an example. In this punch press, a servo motor 42, a planetary gear type speed reducer 45, and a crank shaft 46 are arranged in series. The speed reducer 45 reduces the speed of a rotational output from the servo motor 42 and then transmits the rotational output to the crank shaft 46 via a coupling 47. Then, a crank mechanism 44 converts the rotation of the crank shaft 46 into an elevating and lowering operation of the ram 43. The crank mechanism 44 is installed in a frame 52 composed of paired opposite plates. The servo motor 42 with the planetary speed reducer 45 is attached so as to project laterally from a side of the frame 52 as shown in the plan view in FIG. 10.

In some recent punch presses, the speed reducer is omitted and high-power motors are coupled directly to the respective sides of the crank shaft.

However, in the punch press shown in FIGS. 7 to 10, the servo motor 42, the speed reducer 45, and the crank mechanism 44 are all arranged in series. Thus, disadvantageously, a large length is required to arrange these components, thus increasing the size of the whole punch press.

Further, the servo motor 42 is attached to the frame 52 so as to project far from the frame 52 in a cantilever manner. Consequently, the servo motor 42 tends to vibrate intensely and is thus damaged. This is likely to reduce the lifetime of the motor.

Furthermore, the servo motor 45 and the speed reducer 45, which may act as heat sources, are installed away from the center of the frame 52. This increases a difference in thermal displacement between the right and left sides of the frame 52. Consequently, the frame 52 may be slightly deformed to degrade the machined quality of a plate material work piece W.

Moreover, when the crank shaft 46 is displaced by the load of the ram 43, the speed reducer 45 or a bearing of the motor 42 may be stressed by a shift in the axis. To prevent this, the speed reducer 45 and the crank shaft 46 must be jointed together via the coupling 47 which can absorb a shift in the axis. This increases the number of parts in a drive transmitting system and thus costs.

These problems are not limited to the punch press using the speed reducer 45. Even with the punch press in which high-power motors are coupled directly to the respective ends of the crank shaft, a large length is required to arrange the components, thus increasing the size of the whole punch press, even with a difference in the length by which the motor projects from the frame. Such a punch press also creates the other problems described above.

The punch press shown in the Unexamined Japanese Patent Application Publication (Tokkai-Hei) No. 6-344059 is of a flywheel type in which driving from the motor is transmitted to the flywheel via the belt. It is thus unnecessary to provide a coupling that absorbs displacement of the crank shaft caused by punch loads. However, the use of the flywheel prevents the elevating and lowering speed of the ram from being controlled during a stroke.

Further, in the punch press disclosed in the Unexamined Japanese Patent Application Publication (Tokkai-Hei) No. 6-344059, the motor is placed closer to the crank shaft than to the flywheel with respect to an axial direction of the crank shaft. The motor is markedly biased toward the flywheel with respect to the center of the ram. Consequently, deformation may occur which results from a difference in thermal expansion between the right and left sides of the frame as described above.

It is an object of the present invention to provide a punch press that enables the arrangement length of a motor and a crank mechanism to be reduced so that the motor can be installed without being projected far from a side of a frame, the punch press avoiding biasing the motor, which may act as a heat source, to reduce the magnitude of deformation resulting from a difference in thermal expansion between the right and left sides of the frame.

It is another object of the present invention to be able to accomplish this object using a punch press that can control the speed at which a ram elevates and lowers.

It is further another object of the present invention to eliminate the need to provide a drive transmitting system for a crank shaft with a coupling that absorbs a shift in the axis of the drive transmitting system.

It is further another object to reduce noise generated by the drive transmitting system.

It is further another object to eliminate the impact of a thrust caused by a gear used to reduce the noise.

It is further another object to reduce vibration by offsetting an exciting force generated by rotation of the crank shaft.

SUMMARY OF THE INVENTION

A punch press according to a first aspect of the present invention comprises a servo motor, a ram which is installed so as to freely elevate and lower and which drives a press tool, a crank mechanism which converts a rotating motion transmitted to a crank shaft into an elevating and lowering operation of the ram, and a drive transmitting mechanism provided between the servo motor and the crank shaft to transmit rotation of the servo motor to the crank shaft while reducing a rotation speed so that the elevating and lowering operation of the ram can be controlled by controlling the rotation of the servo motor. The servo motor is placed by the side of the crank mechanism so that a rotating axis of the servo motor is parallel to an axis of the crank shaft. The drive transmitting mechanism comprises a gear mechanism in which a servo motor side gear joined to an output shaft of the servo motor and a crank side gear joined to the crank shaft engage with each other directly or via an intermediate gear.

With this configuration, a rotating motion of the servo motor is transmitted to the crank shaft via the drive transmitting mechanism. The crank mechanism converts the rotating motion into an elevating and lowering operation of the ram. The press tool thus performs a punching operation. The servo motor is placed by the side of the crank mechanism so that the rotating axis of the servo motor is parallel to the axis of the crank shaft. This reduces the arrangement length of the whole driving section to allow the motor to be installed without being projected far from the side of the frame. This in turn reduces vibration of the motor induced by punching to prevent the lifetime of the motor from being reduced by the vibration of the motor. Further, the servo motor, which may act as a heat source, is placed in a central portion of the punch press. This reduces the deformation of the frame caused by a difference in thermal expansion between the right and left sides of the frame. It is thus possible to reduce a decrease in machining accuracy attributed to the thermal displacement. The drive transmitting mechanism comprises the gear mechanism in which the servo motor side gear joined to the output shaft of the servo motor and the crank side gear joined to the crank shaft engage with each other directly or via the intermediate gear. Accordingly, the gear mechanism can absorb the displacement of the crank shaft. This eliminates the need for the coupling used in the conventional example. Further, a parallel-axis speed reducer can be constructed more easily and inexpensively than the planetary speed reducer used in the conventional example. Furthermore, since the serve motor is used as a driving source, the speed of the ram can be freely controlled during a stroke, in contrast to the use of the flywheel. Inertia applying means such as a flywheel which increases a punching force is not provided in the "drive transmitting mechanism that transmits rotation of the servo motor to the crank shaft while reducing the rotation speed of the servo motor so that the elevating and lowering operation of the ram can be controlled by controlling the rotation of the servo motor".

The servo motor side gear and the crank side gear may be helical gears. The helical gear has teeth inclined from the axial direction and thus has a large contact surface. Accordingly, when the same driving force is to be transmitted, helical gears may be smaller than spur gears. Further, a contact gear ratio is advantageously high enough to reduce noise resulting from the engagement. These characteristics of the helical gear allow the punch press to operate quietly and serve to reduce the size of the drive transmitting mechanism.

A punch press according to a second aspect of the present invention comprises a servo motor, a ram which is installed so as to freely elevate and lower and which drives a press tool, a crank mechanism which converts a rotating motion transmitted to a crank shaft into an elevating and lowering operation of the ram, and a drive transmitting mechanism which transmits rotation of the servo motor to the crank shaft while reducing a rotation speed. The servo motor is placed by the side of the crank mechanism so that a rotating axis of the servo motor is parallel to an axis of the crank shaft. The motor has a concentric first and second output shaft portions projecting from respective sides of the motor. Opposite ends of the crank shaft are a first and second input shaft portions, respectively. The drive transmitting mechanism has a first drive transmitting section which transmits rotation from the first output shaft portion to the first input shaft portion of the crank shaft and a second drive transmitting section which transmits rotation from the second output shaft portion to the second input shaft portion of the crank shaft. With this configuration, a rotating motion of the servo motor is transmitted to the crank shaft via the drive transmitting mechanism. The crank mechanism converts the rotating motion into an elevating and lowering operation of the ram. The press tool thus performs a punching operation. The servo motor is placed by the side of the crank mechanism so that the rotating axis of the servo motor is parallel to the axis of the crank shaft. This reduces the arrangement length of the whole driving section to allow the motor to be installed without being projected far from the side of the frame. This in turn reduces vibration of the motor to prevent the lifetime of the motor from being reduced by the vibration of the motor. Further, the servo motor, which may act as a heat source, can be placed in a central portion of the punch press. This hinders machining quality from being degraded by thermal deformation. In particular, the drive transmitting mechanism has the first and second drive transmitting sections which transmit rotations from the first and second output shaft portions, respectively, projecting from the respective sides of the motor, to the corresponding ends of the crank shaft. Accordingly, the components of the drive transmitting mechanism can be arranged in a well-balanced manner in the lateral direction. This avoids projecting the motor in the lateral direction and biasing the motor and drive transmitting system, which may act as heat sources. Consequently, the frame is further reliably prevented from being thermally deformed. Further, driving is transmitted from both sides, thus hindering the action of a moment load and the like. Even the combination of the gears of the first and second drive transmitting sections is small-sized and light compared to the transmission of driving from only one side. This reduces the magnitude of inertia to allow the speed to be more appropriately controlled using a servo motor or the like.

Each of the first drive transmitting section and the second drive transmitting section comprises a gear mechanism in which a motor side gear joined to an output shaft of the motor and a crank side gear joined to a input shaft portion of the crank shaft engage with each other directly or via an intermediate gear. Such a gear mechanism can absorb a shift in the axis of the rotation transmitting system caused by displacement of the crank shaft. This eliminates the need for the coupling used in the conventional example. Further, a parallel-axis speed reducer can be constructed more easily and inexpensively than the planetary speed reducer used in the conventional example.

The teeth of the servo motor side gears and crank side gears of the first and second drive transmitting sections are inclined so that the teeth in the first drive transmitting section are laterally symmetric to the teeth in the second drive transmitting section. The employment of the helical gears enables quieter operations and a reduction in the size of the gear. However, the employment of the helical gears may result in generation of a thrust and means is thus required for receiving the thrust. Thus, the teeth in the first drive transmitting section are laterally symmetric to the teeth in the second drive transmitting section. Accordingly, the thrust is offset between both drive transmitting sections. Therefore, the use of the helical gears does not require that bearings supporting the motor shaft and crank shaft can endure a large thrust.

In the punch presses according to the first and second aspects of the present invention, the drive transmitting mechanism may have the intermediate gear, and the crank shaft may be provided with a first counter balance. Moreover, a second counter balance may be provided on the intermediate gear or a shaft rotating integrally with the intermediate gear. The first counter balance offsets an exciting force that may be generated by rotation of the crank shaft. The second counter balance offsets an exciting force generated by rotation of the crank shaft or by rotation of the first counter balance. These counter balances offset the exciting force generated by rotation of an eccentric portion of the crank shaft. In this case, since the second counter balance is provided on the intermediate gear or the shaft rotating integrally with the intermediate gear, it rotates at a period shorter than that of the crank shaft. For example, the second counter balance rotates at a period half that of the crank shaft. This improves the effect of vibration reduction based on the offsetting of an exciting force.

In the punch press according to the first aspect of the present invention, the servo motor is placed by the side of the crank mechanism so that the rotating axis of the servo motor is parallel to the axis of the crank shaft. The drive transmitting mechanism comprises the gear mechanism in which the servo motor side gear joined to the output shaft of the servo motor and the crank side gear joined to the crank shaft engage with each other directly or via the intermediate gear. Accordingly, even though this punch press enables the elevating and lowering speed of the ram to be controlled using the servo motor, the arrangement length of the motor and the crank mechanism can be reduced to allow the motor to be installed without being projected far in the lateral direction. Further, the punch press avoids biasing the motor, which may act as a heat source, to reduce the magnitude of deformation resulting from a difference in thermal expansion between the right and left sides of the frame. Furthermore, it is unnecessary to provide the drive transmitting system for the crank shaft with a coupling that absorbs a shift in the axis of the system. In the punch press according to the second aspect of the present invention, the servo motor is placed by the side of the crank mechanism so that the rotating axis of the servo motor is parallel to the axis of the crank shaft. The motor has the concentric first and second output shaft portions projecting from respective sides of the motor. Opposite ends of the crank shaft are the first and second input shaft portions, respectively. The drive transmitting mechanism has the first drive transmitting section which transmits rotation from the first output shaft portion to the first input shaft portion of the crank shaft and the second drive transmitting section which transmits rotation from the second output shaft portion to the second input shaft portion of the crank shaft. Accordingly, the arrangement length of the motor and the crank mechanism can be reduced to allow the motor to be installed without being projected far in the lateral direction. Further, the punch press avoids biasing the motor, which may act as a heat source, to reduce the magnitude of deformation resulting from a difference in thermal expansion between the right and left sides of the frame.

DETAILED DESCRIPTION OF THE PREFERRED EMBODIMENTS

Figure 1:
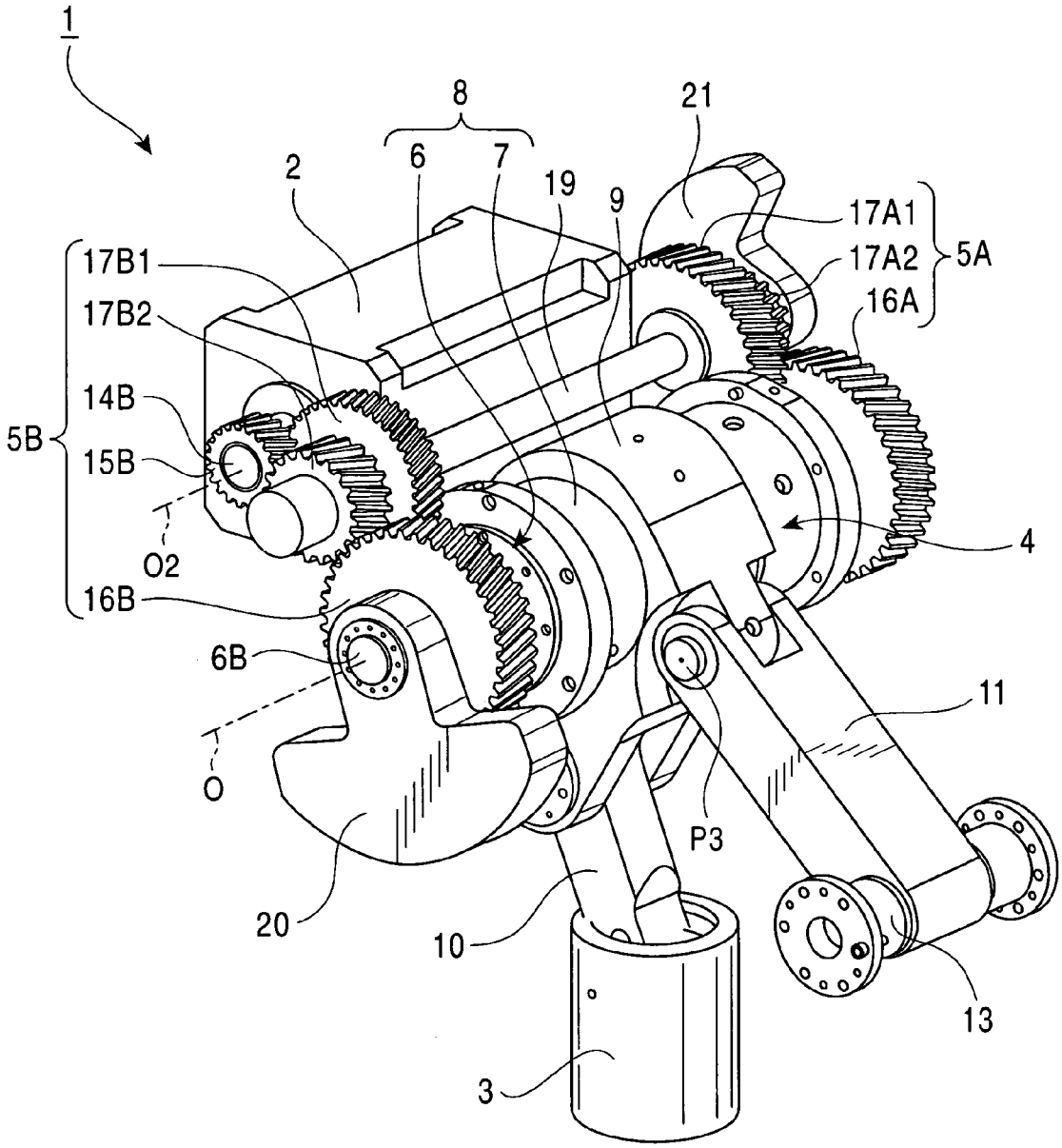
FIG. 1 is a perspective view showing a connecting structure for a servo motor and a crank mechanism of a punch press according to an embodiment of the present invention.

An embodiment of the present invention will be described with reference to FIGS. 1 to 6. FIG. 1 is a perspective view of a punch driving section in a punch press. The punch driving section 1 comprises a servo motor 2, a ram 3 which is installed so as to freely elevate and lower and which drives a press tool, a crank mechanism 4 that converts a rotating motion transmitted to a crank shaft 6 into an elevating and lowering operation of the ram 3, and a drive transmitting mechanism 5 provided between the servo motor 2 and the crank shaft 6. The drive transmitting mechanism 5 transmits rotation of the servo motor 2 to the crank shaft 6 while reducing the rotation speed so that the elevating and lowering operation of the ram 3 can be controlled by controlling the rotation of the servo motor 2. As shown in FIG. 4, the crank mechanism 4 has a crank member 8 having an eccentric shaft portion 7 eccentric to the axis of the crank shaft 6, a pivoting link 9 connected to the eccentric shaft portion 7, and a connecting rod 10. In this embodiment, the crank mechanism 4 is of a link press type in which a restricting link 11 is connected to the pivoting link 9. The restricting link 11 mechanically varies an elevating and lowering speed curve for the ram 3 so that a speed curve for lowering and a speed curve for elevation are asymmetric with respect to a bottom dead center. If the ram 3 is mechanically caused to perform symmetrical operations, the restricting link 11 is not provided. The crank shaft 6 is rotatably installed in a frame 12 (FIG. 5) to receive a rotative driving force. The ram 3 is a member that causes a punch tool 24 to elevate and lower. The ram 3 is installed so as to freely elevate and lower via a guide member 31. The ram 3 is located immediately below the crank shaft 6.

The pivoting link 9 has a first to third connecting portions P1 to P3. The pivoting link 9 is connected to the eccentric shaft portion 7 of the crank member 8 using the first connecting portion P1. Each of the connecting portions P1 to P3 establishes a rotatable connection and is located at the corresponding vertex of a triangle. This triangle is an arbitrary one in a plane perpendicular to the axis 0 of the crank shaft 6. The connecting rod 10 has an upper end connected to the second connecting point P2 of the pivoting link 9 and a lower end rotatably connected to an upper end of the ram 3. The restricting link 11 has a base end rotatably supported on the frame 12 via a support shaft 13 and a leading end connected to the third connecting point P3 of the pivoting link 9.

Figure 2:
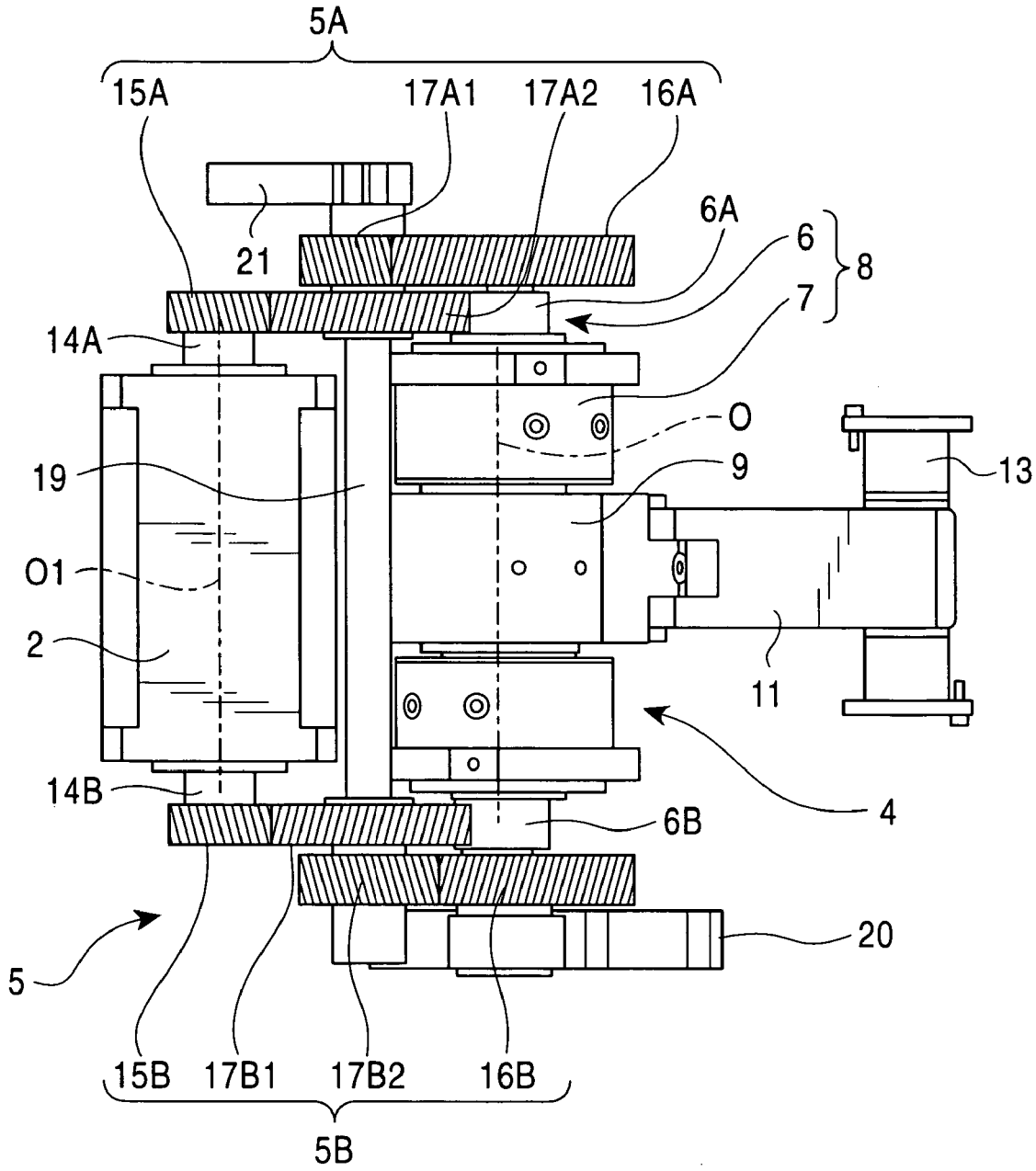
FIG. 2 is a plan view of the connecting structure.
Figure 3:
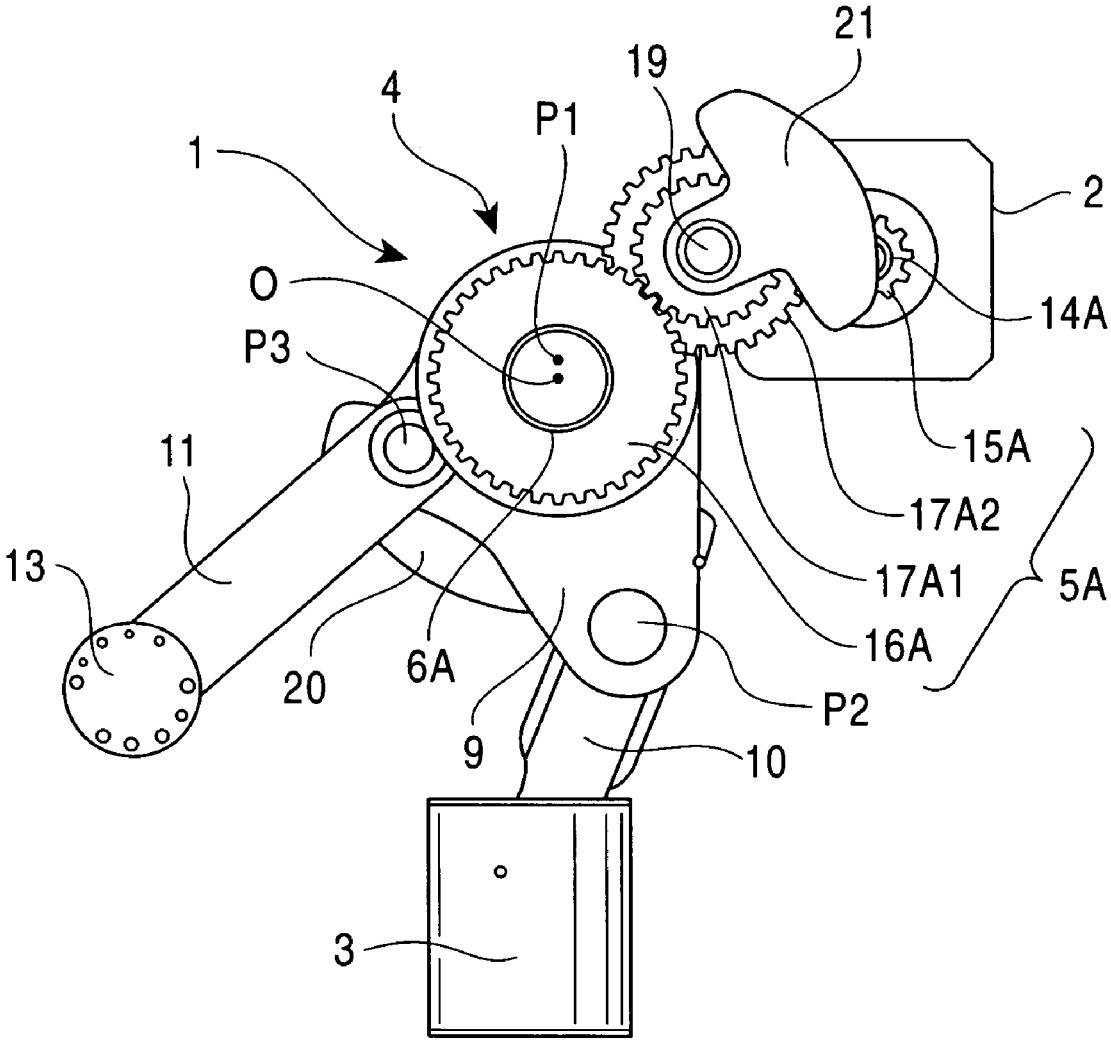
FIG. 3 is a front view of the connecting structure.
Figure 4:
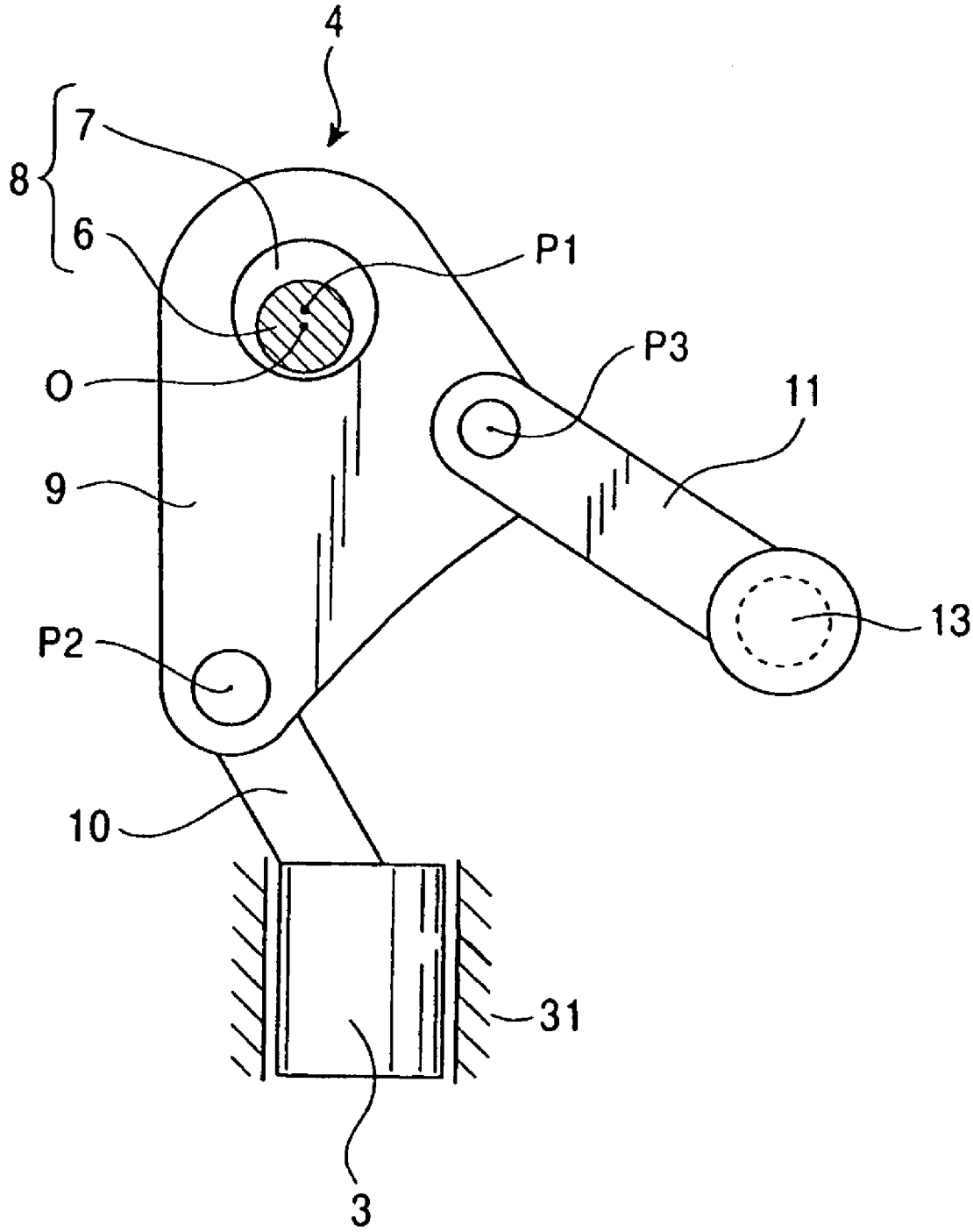
FIG. 4 is an exploded side view of the crank mechanism.

As shown FIGS. 1 to 3, the servo motor 2 is placed by the side of the crank mechanism 4 so that its rotating axis 01 is parallel to the axis 0 of the crank shaft 6. The servo motor 2 is placed so that its center substantially coincides with the center of the crank mechanism 4 in a width direction (that is, a direction along the axes 01, 0). The drive transmitting mechanism 5 is composed of a first drive transmitting section 5A and a second drive transmitting section 5B separated from each other in the lateral direction. The servo motor 2 has a concentric first and second output shaft portions 14A, 14B projecting from the respective sides of the motor 2. The opposite ends of the crank shaft 6 are a first and second input shaft portions 6A, 6B, respectively. The first drive transmitting section 5A transmits rotation from the first output shaft portion 14A to the first input shaft portion 6A of the crank shaft 6. The second drive transmitting section 5B transmits rotation from the second output shaft portion 14B to the second input shaft portion 6B of the crank shaft 6.

The first drive transmitting section 5A is composed of a gear mechanism in which a servo motor side gear 15A joined to the first output shaft portion 14A and a crank shaft side gear 16A joined to the first input shaft portion 6A of the crank shaft 6 engage with each other via intermediate gears 17A1, 17A2. Like the first drive transmitting section 5A, the second drive transmitting section 5B is composed of a gear mechanism in which a servo motor side gear 15B joined to the second output shaft portion 14B and a crank shaft side gear 16B joined to the second input shaft portion 6B of the crank shaft 6 engage with each other via intermediate gears 17B1, 17B2. The intermediate gears 17A1, 17A2, 17B1, 17B2 are fixed to a common intermediate shaft 19. The intermediate shaft 19 is provided parallel to the rotating axis 01 of the servo motor 2 and is rotatably supported on the frame 12. Each of the gears constituting the drive transmitting mechanism 5 is composed of a helical gear with inclined teeth. The teeth of the servo motor side gears 15A, 15B and crank side gears 16A, 16B of the first and second drive transmitting sections 5A, 5B are inclined so that the teeth in the first drive transmitting section 5A are laterally symmetric to the teeth in the second drive transmitting section 5B. The teeth of the two intermediate gears 17A1, 17A2 of the first drive transmitting section 5A are inclined so that the teeth of the intermediate gear 17A1 are laterally symmetric to the teeth of the intermediate gear 17A2. The teeth of the two intermediate gears 17B1, 17B2 of the second drive transmitting section 5B are inclined so that the teeth of the intermediate gear 17B1 are laterally symmetric to the teeth of the intermediate gear 17B2. The drive transmitting mechanism 5 may be composed of only one of the first and second drive transmitting sections 5A, 5B. The servo motor side gears 15A, 15B may engage directly with the crank side gears 16A, 16B, respectively, without using the intermediate gears 17A1 to 17B2.

A first counter balance 20 is provided on the second input shaft portion 6B of the crank shaft 6. A counter balance 21 is provided at an end of the intermediate shaft 19 which is located at the intermediate gears 17A1, 17A2; the intermediate shaft 19 rotates integrally with the intermediate gears 17A1 to 17B2. The first counter balance 20 offsets an exciting force generated rotation of the crank shaft 6. The second counter balance 21 offsets an exciting force generated by rotation of the crank shaft 6 or by rotation of the first counter balance 20. Each of these counter balances 20, 21 may be provided both in the first drive transmitting section 5A and in the second drive transmitting section 5B. In this case, the counter balances 20, 21 can be installed so as to keep the balance more easily.

Figure 5:
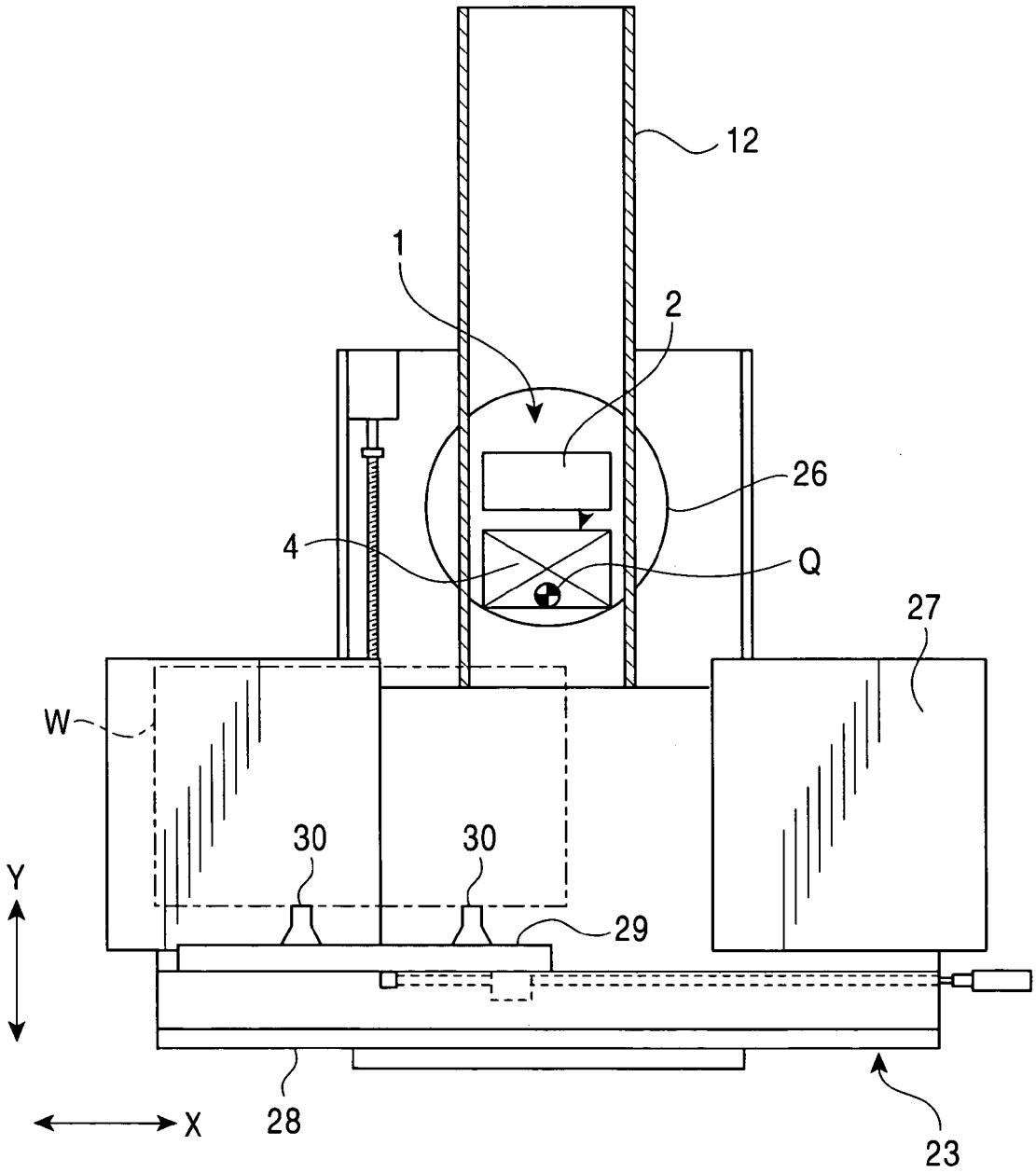
FIG. 5 is a plan view showing the general configuration of the punch press.
Figure 6:
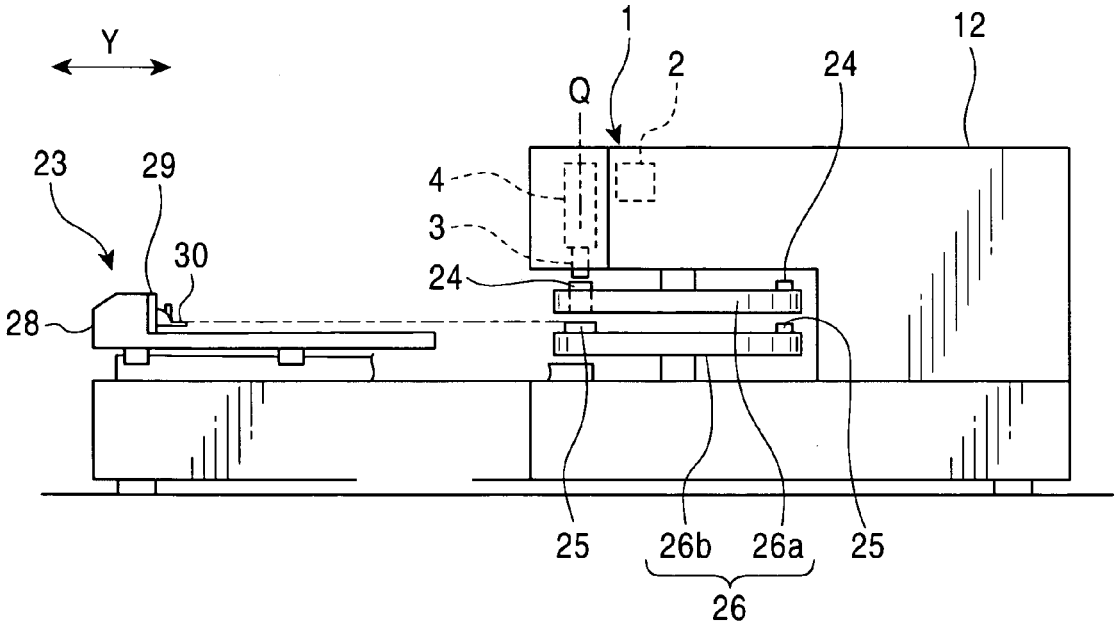
FIG. 6 is a right side view of the punch press.
Figure 7:
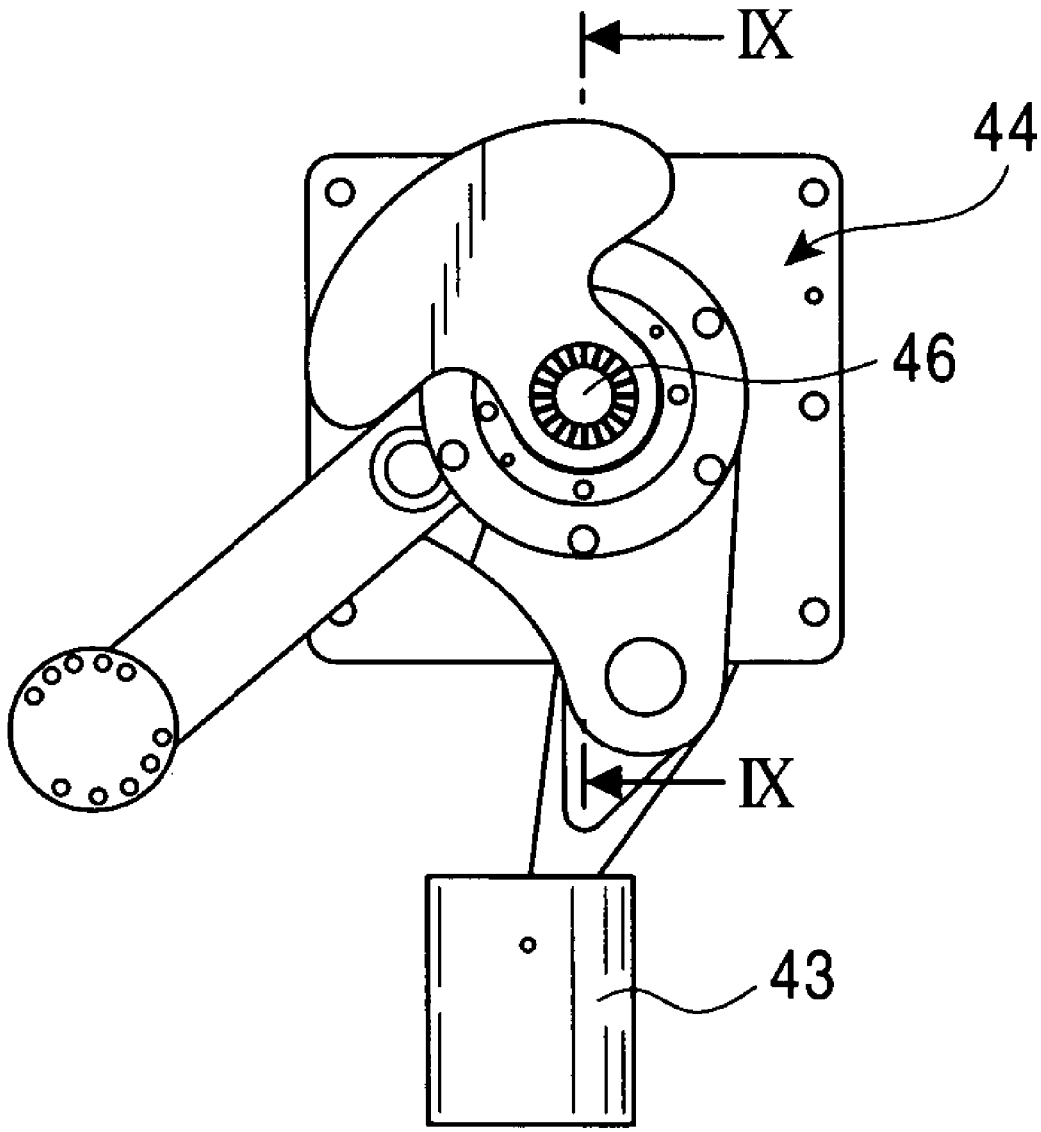
FIG. 7 PRIOR ART
FIG. 7 is a side view showing a connecting structure for a servo motor and a crank mechanism of a conventional punch press.
Figure 8:
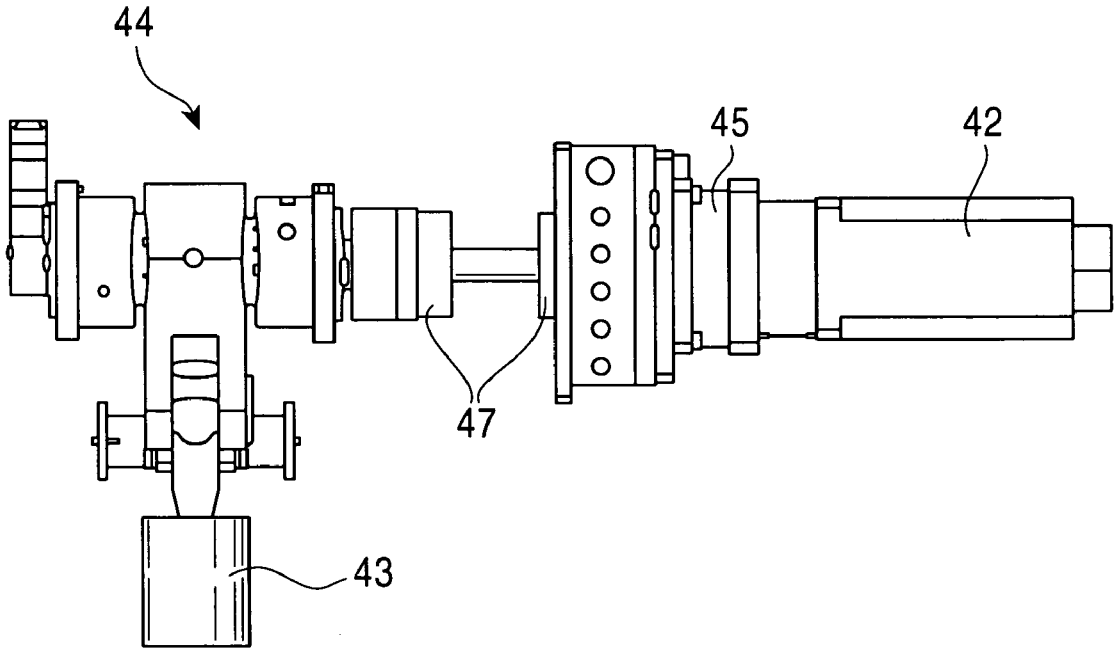
FIG. 8 PRIOR ART
FIG. 8 is a front view of the connecting structure.
Figure 9:
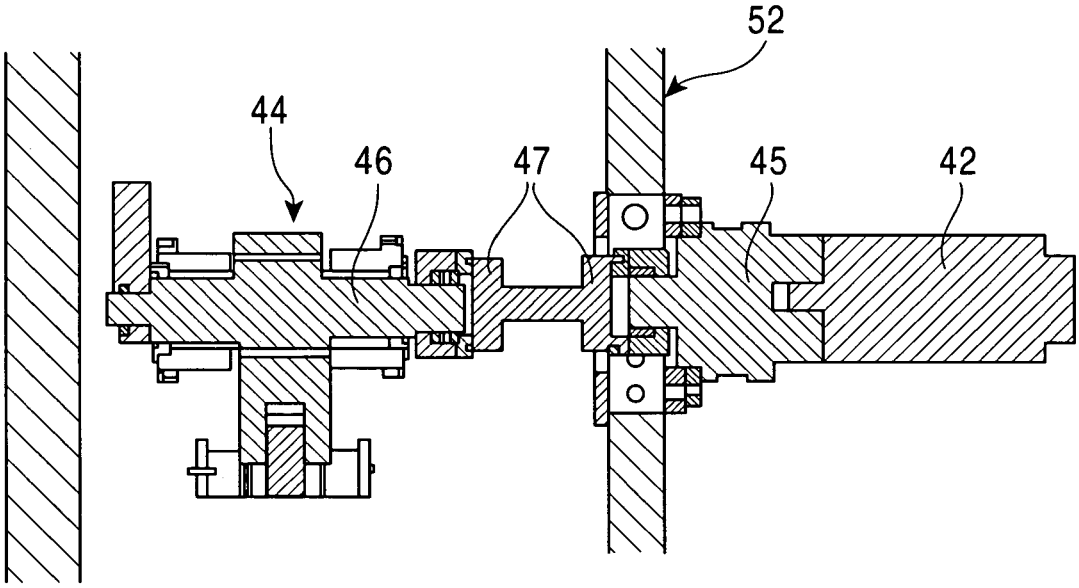
FIG. 9 PRIOR ART
FIG. 9 is a sectional view taken along a line IX-IX in FIG. 7.
Figure 10:
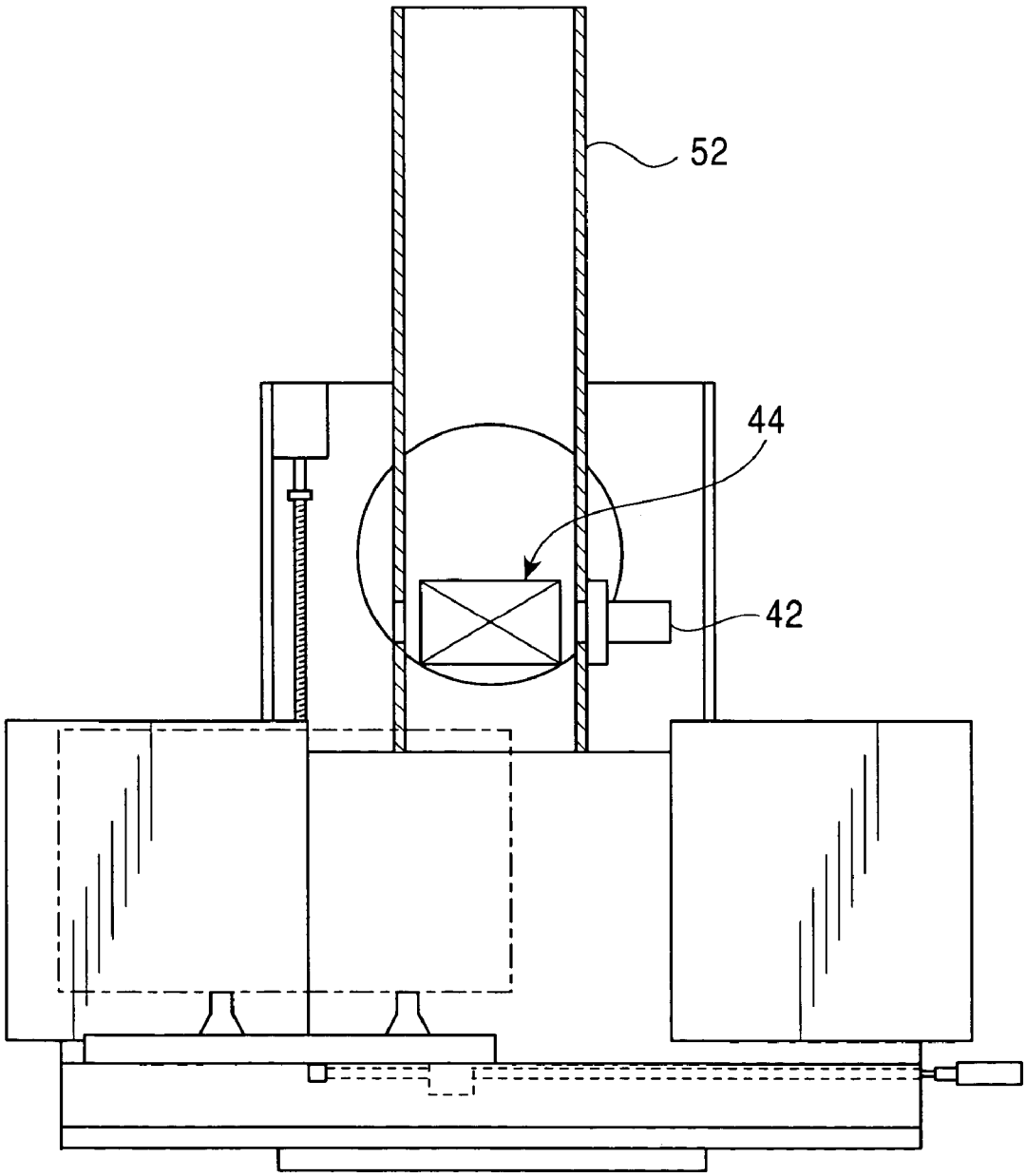
FIG. 10 PRIOR ART
FIG. 10 is a plan view showing the general configuration of the conventional punch press.

FIGS. 5 and 6 are a plan view and a side view, respectively, of the whole punch press according to this embodiment. The frame 12, on which the punch driving section 1 is supported, has paired opposite side plates. Not only the punch driving section 1 but also tool supporting means 26 and work feeding means 23 are installed in the frame 12. The tool supporting means 26 is composed of an upper and lower turrets 26*a*, 26*b*. A plurality of punch tools 24 are mounted on the upper turret 26*a*, and a plurality of die tools 25 are mounted on the lower turret 26*b*. The work feeding means 23 moves a plate material work piece W on a table 27 in two orthogonal axial directions (X and Y axes) so that an arbitrary part of the work piece W sits at a pressing position Q. The work feeding means 23 has a carriage 28 that moves in a longitudinal direction (Y-axis direction) and a cross slide 29 mounted on the carriage 28 and moving in a lateral direction (X-axis direction). The plate material work piece W is gripped by a plurality of work holders 30 provided on the cross slide 29. The plate material work piece W is fed in the two axial directions by moving the carriage 28 in the longitudinal direction and the cross slide 29 in the lateral direction.

Operations of the above configuration will be described.

A rotational output from the servo motor 2 is transmitted to the crank shaft 6 via the drive transmitting mechanism 5. The center of the eccentric shaft portion 7 of the crank member 8 follows a circumferential track around the axis 0 of the crank shaft 6. The pivoting link 9 is rotatably connected to the eccentric shaft portion 7 using the first connecting portion P1. Accordingly, the pivoting link 9 makes a revolving motion along the circumferential track. The pivoting link 9 has its operation regulated by being connected to the regulating link 8 using the third connecting portion P3. Simultaneously with the revolving motion, the pivoting link 9 makes a rotating motion, that is, is rotated clockwise and counterclockwise around the first connecting portion P1. The composite operation of the revolving motion and rotating motion causes the second connecting portion P2 with the connecting rod 10 of the pivoting link 9 to move along an oblique elliptical track. The ram 3 is supported so as only to elevate and lower freely and is connected to the second connecting portion P2 of the pivoting link 9 via the connecting rod 10. Consequently, the ram 3 elevates and lowers as the second connecting portion P2 follows an elliptical track. The lowering speed of the ram 3 is not equal to the elevating speed of the ram 3. The crank angle measured when the ram 3 reaches a bottom dead center is not 180 degrees. In this manner, the serve motor 2 controls the elevation and lowering of the ram 3 to allow the punch tool 24 to perform a punching operation.

In the punch press according to this embodiment, the servo motor 2 is placed by the side of the crank mechanism 4 so that its rotating axis is parallel to the axis of the crank shaft 6. Accordingly, the arrangement length of the whole punch driving section 1 can be reduced.

Further, the servo motor 2, acting as a driving source, can be placed without projecting out of the frame 12. That is, it is possible to avoid projecting the servo motor 2 far out of the frame 12 in a cantilever manner as in the case of the prior art. This makes it possible to reduce the vibration of the motor 2 to prevent the servo motor 2 from being damaged by the vibration.

Furthermore, the servo motor 2, which may act as a heat source, is placed in the central portion of the punch press. This eliminates the difference in thermal expansion between the right and left parts of the frame 12. This prevents the machined quality from being degraded by deformation of the frame 12 caused by a difference in thermal expansion.

The drive transmitting mechanism 5 is composed of the gear mechanism in which the servo motor side gears 15A, 15B, connected to the respective output shafts 14A, 14B of the servo motor 2, engage, directly or via the intermediate gears 17A1 to 17B2, with the crank side gears 16A, 16B, respectively, joined to the crank shaft 6. Accordingly, even if the crank shaft 6 is displaced by a punching reaction force, the gear mechanism can absorb a shift in the axis of the transmission system of the drive transmitting mechanism 5. This eliminates the need for the coupling used in the conventional example to absorb a shift in the axis. Further, the drive transmitting mechanism 5 may be a parallel-axis speed reducer that can be constructed more easily and inexpensively than the planetary speed reducer used in the conventional example.

The servo motor side gears 15A, 15B and the crank side gears 16A, 16B are helical gears. The helical gears are characterized by having oblique teeth, thus serving to reduce noise from the drive transmitting mechanism 5. Owing to the oblique teeth, the helical gears are also small in size. Thus, the size of the drive transmitting mechanism 5 can be reduced.

The drive transmitting mechanism 5 is composed of the first drive transmitting section 5A, which transmits rotation from the first output shaft portion 14A of the servo motor 2 to the first input shaft portion 6A of the crank shaft 6, and the second drive transmitting section 5B, which transmits rotation from the second output shaft portion 14B of the servo motor 2 to the second input shaft portion 6B of the crank shaft 6. The drive transmitting mechanism 5 is laterally symmetric, thus preventing the action of an extra load such as a moment load. This also serves to reduce the sizes of the gears. Moreover, the teeth of the servo motor side gear 15A, 15B and crank side gears 16A, 16B of the first and second drive transmitting sections 5A, 5B are inclined so that the teeth in the first drive transmitting section 5A are laterally symmetric to the teeth in the second drive transmitting section 5B. A possible thrust resulting from the use of the helical gears is offset between the first drive transmitting section 5A and the second drive transmitting section 5B. Thus, the drive transmitting mechanism 5 can be stably installed.

Moreover, the counter balance 20 is provided on the second input shaft portion 6B of the crank shaft 6. The different counter balance 21 is provided on the intermediate gears 17A1, 17A2 of the drive transmitting mechanisms 5 or at the end of the intermediate gear shaft 19 at which the intermediate gears 17A1, 17A2 are installed. Consequently, the drive transmitting mechanism 5 can be easily balanced. Specifically, if the counter balance 20 is attached only to the crank shaft 6, the effect of vibration reduction is limited because the counter balance 20 rotates at the same period as that of the crank shaft in the same direction as that in which the crank shaft rotates. However, the above installation and arrangement of the counter balances 20, 21 causes the intermediate shaft 19 of the intermediate gears 17A1 to 17B2 to rotate in the direction opposite to that in which the crank shaft 6 rotates. The rotation speeds of the counter balances 20, 21 increase with a speed reducing ratio. Accordingly, the use of an integral multiple of the speed reducing ratio enables the counter balance 21 of the intermediate shaft 19 to perform balancing operations at a small period. This in turn enables appropriate balancing. Both counter balances 20, 21 may be provided in each of the first and second drive transmitting sections 5A, 5B. In this case, the drive transmitting mechanism 5 can be more easily balanced.

The invention claimed is:

1. A punch press, comprising:

a motor;

a ram which is installed so as to freely elevate and lower and which drives a press tool;

a crank mechanism which converts a rotating motion transmitted to a crank shaft into an elevating and lowering operation of said ram; and a drive transmitting mechanism which transmits rotation of the motor to said crank shaft while reducing a rotation speed, said motor being placed by the side of said crank mechanism so that a rotating axis of said motor is parallel to an axis of said crank shaft, said motor having a concentric first and second output shaft portions projecting from respective sides of the motor, opposite ends of said crank shaft being a first and second input shaft portions, respectively, said drive transmitting mechanism having a first drive transmitting section which transmits rotation from said first output shaft portion to the first input shaft portion of said crank shaft and a second drive transmitting section which transmits rotation from said second output shaft portion to the second input shaft portion of said crank shaft.

2. A punch press according to claim 1, wherein each of said first drive transmitting section and said second drive transmitting section comprises a gear mechanism in which a motor side gear joined to an output shaft of the motor and a crank side gear joined to a input shaft portion of said crank shaft engage with each other directly or via an intermediate gear.

3. A punch press according to claim 2, wherein teeth of said motor side gears and crank side gears of said first and second drive transmitting sections are inclined so that the teeth in the first drive transmitting section are laterally symmetric to the teeth in the second drive transmitting section.

4. A punch press according to claim 2, wherein the drive transmitting mechanism has said intermediate gear, said crank shaft is provided with a first counter balance, and a second counter balance is provided on said intermediate gear or a shaft rotating integrally with the intermediate gear.

* * * * *